US007523929B2

(12) United States Patent
Surprise et al.

(10) Patent No.: US 7,523,929 B2
(45) Date of Patent: Apr. 28, 2009

(54) SHINGLE MODE MEDIA ITEM FEED ARRANGEMENT

(75) Inventors: Donald Surprise, Waterbury, CT (US); Norman R. Lilly, Monroe, CT (US); James A. Fairweather, Milford, CT (US); Theresa Bartick, Gorham, ME (US)

(73) Assignee: Pitney Bowes Inc., Stamford, CT (US)

( * ) Notice: Subject to any disclaimer, the term of this patent is extended or adjusted under 35 U.S.C. 154(b) by 522 days.

(21) Appl. No.: 11/267,389

(22) Filed: Nov. 4, 2005

(65) Prior Publication Data

US 2007/0102865 A1 May 10, 2007

(51) Int. Cl.
*B65H 1/08* (2006.01)

(52) U.S. Cl. ..... 271/126; 271/149; 271/150

(58) Field of Classification Search ..... 271/149, 271/150, 126

See application file for complete search history.

(56) References Cited

U.S. PATENT DOCUMENTS 1,077,408 A * 11/1913 Ielfield ..... 101/237
4,635,922 A * 1/1987 Roetter et al. ..... 271/119
4,884,795 A * 12/1989 Vander Syde ..... 271/34
5,413,323 A * 5/1995 Imbert et al. ..... 271/149
5,685,533 A * 11/1997 Hartsoe ..... 271/11
6,805,343 B2 * 10/2004 Kosugi ..... 271/147
6,869,072 B2 * 3/2005 Andersson ..... 271/149
6,896,255 B1 * 5/2005 Fick et al. ..... 271/126

* cited by examiner

*Primary Examiner*—David H Bollinger
(74) *Attorney, Agent, or Firm*—Steven J. Shapiro; Angelo N. Chaclas

(57) ABSTRACT

A method and an arrangement for feeding shingled media item includes a tray for supporting a stack of shingled media items. The tray has an exit area and each of the media items has a bottom edge. A feeder separates and feeds media items from the shingled stack of media items. The tray is connected to the feeder with a first and a second cavity formed at the exit area of the feed tray and the front of the feeder such that media items moved from the tray into the feeder are supported on a portion of the media item bottom edge. A rail structure is attached to the surface for supporting the media items bottom edge adjacent the media item exit area. The feeder may include a separator roller and a feed roller positioned with respect to the first and the second cavity such that the media items are moved from a media item shingle orientation upstream of the separator roller and the feed roller to a media item feed orientation down stream of the separator roller and the feed roller with said media item side edges out of contact with the feed head guide surfaces.

10 Claims, 6 Drawing Sheets

SHINGLE MODE MEDIA ITEM FEED ARRANGEMENT

RELATED APPLICATIONS

This U.S. patent application Ser. No. 11/267,389, for SHINGLE MODE FEED MEDIA ITEM FEED ARRANGEMENT, filed Nov. 4, 2005, in the names of Theresa Bartick, Donald Surprise, Norman R. Lilly, and James A. Fairweather, includes: partial common; inventorship, drawings, and detailed description; and common; filing date and assignee with U.S. patent application Ser. No. 11/267,003, for MULTIMODE STACK AND SHINGLE DOCUMENT FEEDER, filed Nov. 4, 2005, in the names of James A. Fairweather, Thomas M. Lyga and Theresa Bartick and U.S. patent application Ser. No. 11/266,878, for SHINGLE MEDIA ITEM FEED TRAY WITH SPRING LOADED SELF LOCKING SLED, filed Nov. 4, 2005 (now U.S. Pat. No. 7,427,063), in the names of James A. Fairweather, Donald Surprise, James A. Salomon, Norman R. Lilly, Thomas M. Lyga.

FIELD OF THE INVENTION

The present invention relates to paper handling systems, such as, printers, folders or inserter systems, and more particularly to a shingle mode media item feed arrangement.

BACKGROUND OF THE INVENTION

Various paper handling systems are designed to process a wide variety of media items. These media items may be of various sizes and shapes and of various types of materials and documents. For example, if the media items are envelopes or other items such as third length slips, trifolds, or business return envelopes and small booklets, to accommodate and process a volume of items, the envelope may be shingled in a shingle feed tray. When these media items are moved from the shingle feed tray into the feeder mechanism, as the case may be, the items are separated from the other media in the tray for processing in the system. In this mode, the media items are stacked on edge in a feed tray and fed from the tray into the feeder.

To provide stack forces on the shingled media item, the angle of the feed tray with respect to a feeder has been varied, as has the weight of a moveable sled provided to urge the shingled media items toward the feeder. Feeders have utilized shingle feed trays mounted to the feeder with various tray angles such as between 22 and 25 degrees, to facilitate movement of the media items from the feed tray into the feeder. Arrangements of this type are employed in Pitney Bowes Inc. of Stamford, Conn., inserter products, such as the Pitney Bowes DI350, DI400, DI500, DI600, DI800 console inserter systems. At such angles, most shingled media items readily slide down the feed tray guided by the side guides of the tray. However, the stack force against the feeder nudger separator system to singulate shingled media items from the stack of media items in the feed tray becomes a strong function of the amount of shingled media items in the feed tray.

The reliable performance of the feeder in singulating the shingled media items becomes impacted by the amount of shingled media items in the feed tray pressing against the current media item to be singulated. Treatments have been added to the surface of the side guides of shingle feed trays to regulate the friction between the shingled media items and the side guides. These treatments are implemented in efforts to increase reliable movement of the shingled media item stack toward the exit area of the feed tray and the feeding and singulation of the media item at the feed tray exit area. Side Guide treatments have included tapes, Teflon paints, oils, and plastic shims. Side Guide treatments of this type have been employed in products such as the Pitney Bowes DI350, DI400, DI500, DI600, DI800 and console inserter systems.

The media in a shingle feed tray are usually stacked at an angle with the rear most media item resting against a sloped sled that advances as media items are moved from the shingle feed tray into the feeder of the paper handling equipment. Accordingly the media items are presented to the feeder in a trapezoidal form. The stack of shingled media items are in the shape of a trapezoidal solid. The media items are presented to the feeder with the weight of the trapezoid media items stack pressing against the nudger system.

Shingle feed problems have been encountered in moving media items from a shingled feed tray into a feeder due, in part, to distortions of the media items such as packaging, envelope "propeller", etc. Envelope distortion due to propeller is induced when the paper used to construct envelopes reacts to the moisture content of the air. The orthotropic expansion response of paper to moisture results in a twist of the form of the envelope, which forms a saddle curve shape under the strain. In addition, poor packaging of envelopes can result in media distortion, as envelopes typically have non-uniform thicknesses that result in uneven pressures between envelopes when packed in boxes for transport. Additional problems are created when shingle media advances to the nudgers, as the friction at the base of the piece can cause the media to gradually "stand-up", moving from a trapezoidal shape to a more rectangular shape. In the rectangular configuration, the incident angle between the tray and media increases, resulting in a greater propensity for the media to stub into the tray surface and skew.

The distortions noted above can create unbalanced forces on the media items, which may result in skew of the media items as they are moved from the shingle feed tray into the feeder. Various approaches to this problems have involved arrange feed nudger arrangements to control the orientation of the shingled stack. Such products have also employed highly polished side guides to eliminate potentially problematic stubs of the corners of material on the media side guides. Examples of such arrangements are employed in the Pitney Bowes DI350 and D500 and DI600 inserters. In these products, attention has been paid to the formation of the corner between the vertical and horizontal surfaces of the side guides. In addition, outboard support of the media is provided via external, outboard, nudgers (nudgers located toward the edges of the media) that act to support and induce even uniform bending of the media being fed. A high degree of complexity is introduced by the inclusion of the outboard nudgers, as to remain effective, the nudger location in such arrangements move inward and outward to follow the adjustment of the side guides.

The bending of the media items as they are moved into the feeder can further exacerbate the feeding problem of the shingled media items and result in jamming of the equipment as skewed items are bent and moved into the feeder mechanism. As media advances from the shingle tray to the separator, the media must be bent from a near vertical orientation in the shingle tray to a near horizontal orientation in the feed head. As bending forces can be significant, uneven contact of the media across the width of the tray results in a net moment about the center of gravity of the envelope, inducing a skewed orientation of the media.

SUMMARY OF THE INVENTION

It is an object of the present invention to provide an improved arrangement for media items for feeding shingled media items as they are moved from a stack of shingled media items into a feeder.

It is a further object of the present invention to provide an arrangement for feeding shingled media items that reduces feeding problems due to distortions in the media items.

It is yet another object of the present invention to provide an improved shingled media feed tray and an improved feed head guide arrangement.

A shingled media item feeding arrangement embodying the present invention includes a tray for supporting a stack of shingled media items. The tray has an exit area and each of the media items has a bottom edge. A feeder separates and feeds media items from the shingled stack of media items. The tray is connected to the feeder with a first and a second cavity formed at the exit area of the feed tray and the front of the feeder such that media items moved from the tray into the feeder are supported on a portion of the media item bottom edge.

In accordance with an aspect of the present invention the shingle media item feed tray a media storage structure having a surface adapted to support a plurality of media items. The media support surface has a media item exit area and the media items have a bottom edge. A rail structure is attached to the surface for supporting the media items bottom edge adjacent the media item exit area.

In accordance with another aspect of the present invention, a feeder for a shingled stack of media items includes a feed head having media item guide surfaces, a separator roller and a feed roller for separating and feeding media items from the shingled stack of media items and a first and a second cavity. The separator roller and the feed roller are positioned with respect to the first and the second cavity such that the media items are moved from a media item shingle orientation upstream of the separator roller and the feed roller to a media item feed orientation down stream of the separator roller and the feed roller with said media item side edges out of contact with the feed head guide surfaces whereby media item bending occurs in the absence of unbalancing forces on said media item edges.

A method for feeding media items from a stack of shingled media items embodying the present invention includes the steps of supporting the stack of shingled media items in astray, the tray having a support surface and a media item exit area, each of the media items having a bottom edge. Connecting the tray to a feeder. Moving the media items toward the media item exit area. Supporting only a portion of the media item bottom edge of each media item when such media item has moved adjacent the tray exit area. And, moving the media items out of the feed tray media item exit area and into the feeder.

BRIEF DESCRIPTION OF THE DRAWINGS

Reference is now made the various figures wherein similar reference numerals designate similar items in the various views and in which.

DETAILED DESCRIPTION OF THE PREFERRED EMBODIMENT

Figure 1:
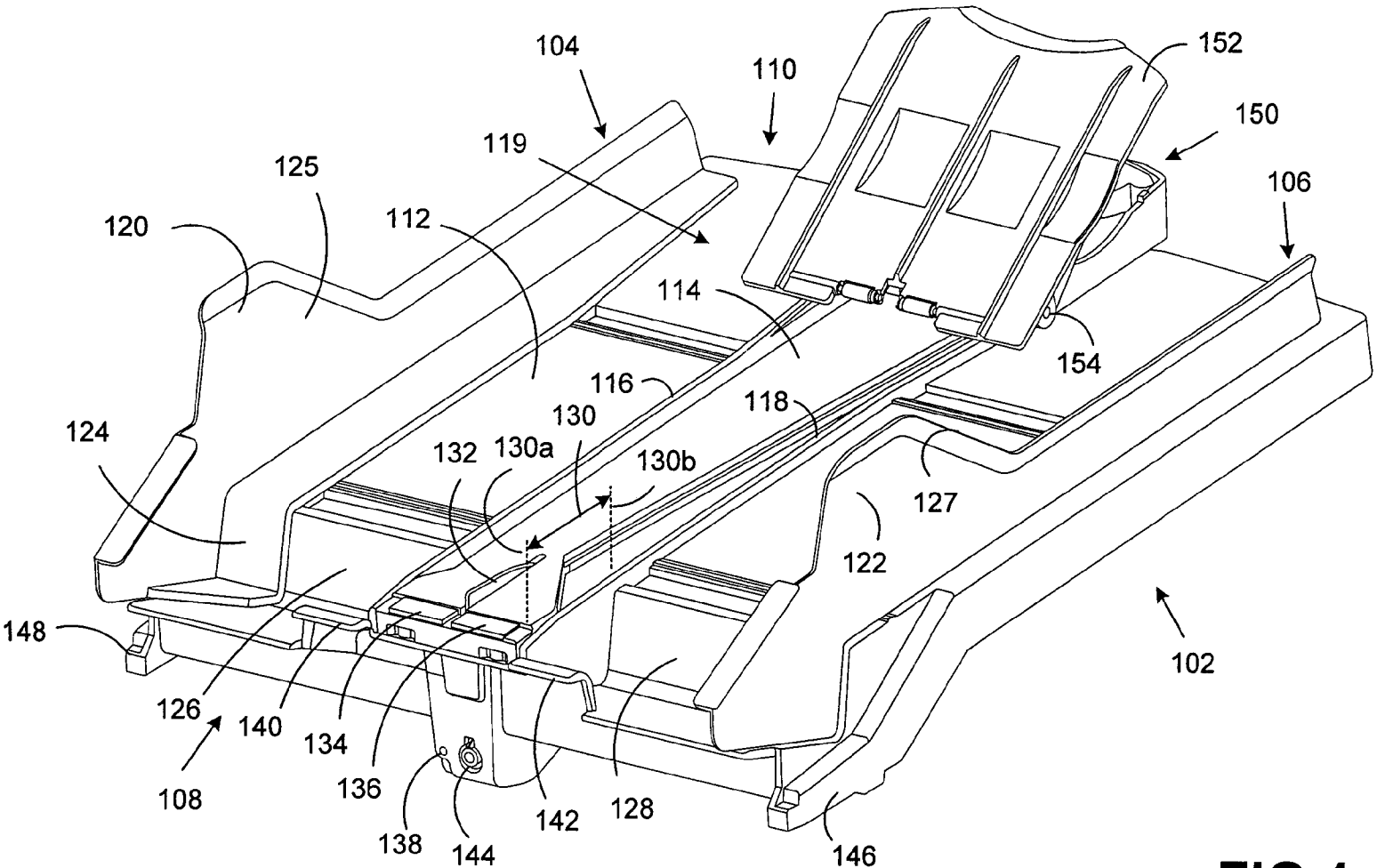
FIG. 1 is a perspective view of a shingle feed tray for media items embodying the present invention.
Figure 2:
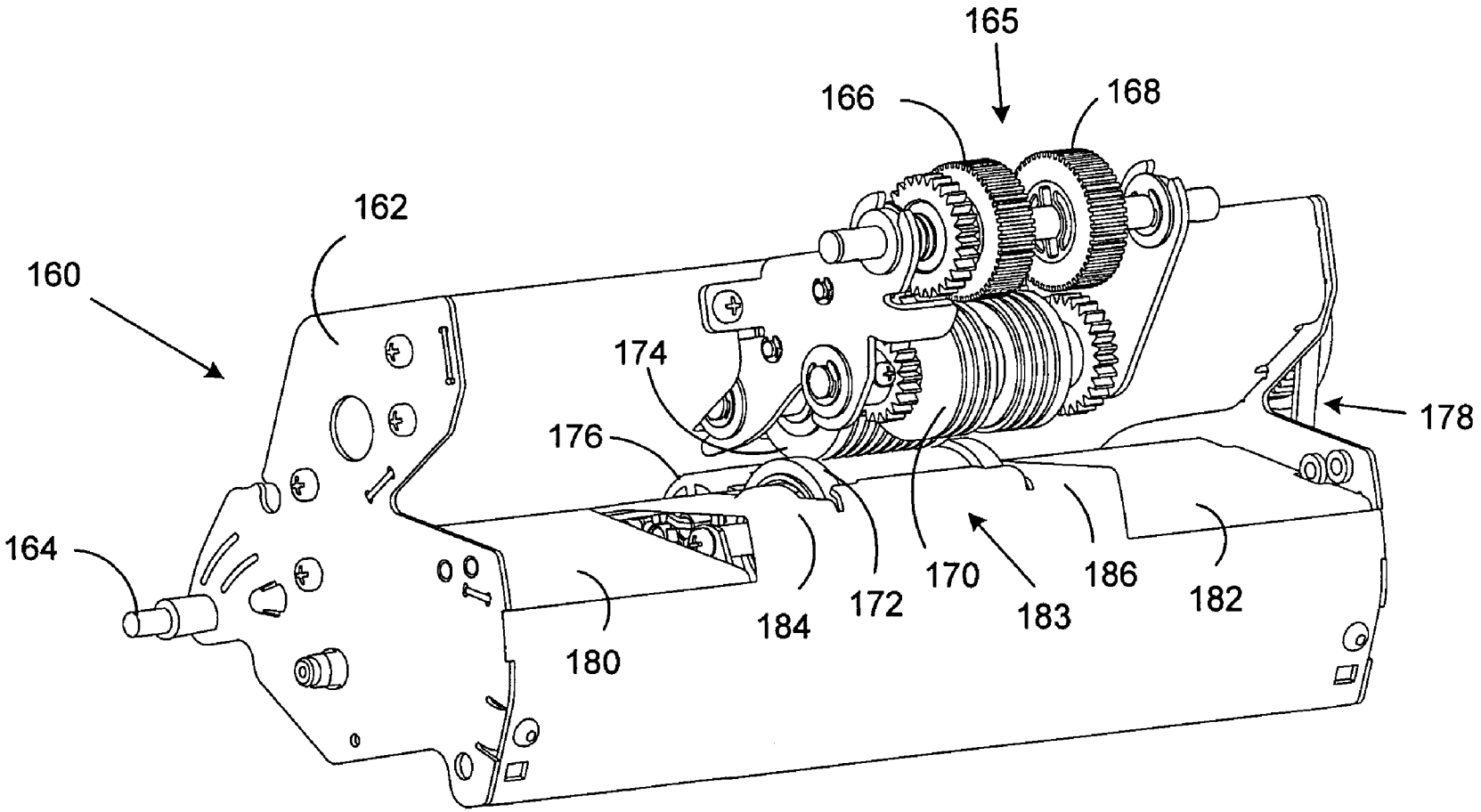
FIG. 2 is a perspective view of a portion of a feeder adapted to work in conjunction with the feed tray shown in FIG. 1 and embodying aspects of the present invention.
Figure 3:
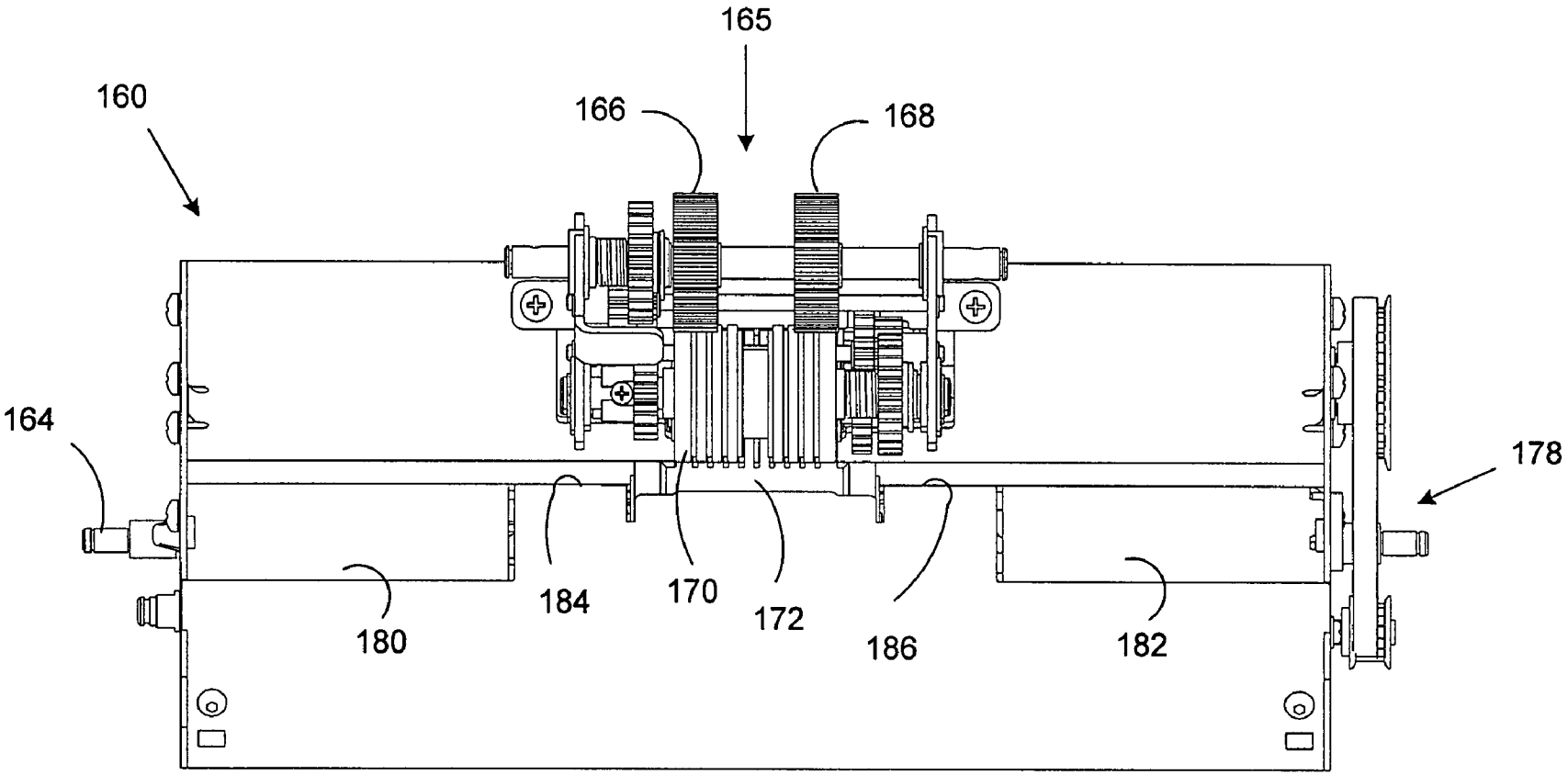
FIG. 3 is a front view of the feeder shown in FIG. 2.

Reference is now made to the various figures. A shingle media feed tray 102 includes moveable side guides 104 and 106 adapted to contact the edges of media items loaded into the tray. The side guides 104 and 106 help guide media items as they are moved toward the exit area 108 of the tray 102 from the rear area 110 of the tray 102. The tray includes a bottom surface 112 onto which are mounted a tapered rail 114 and two support rails 116 and 118. The support rails 116 and 118 are designed to support the bottom edge of shingled media loaded into the shingle tray 102 and are higher, rising above the surface of the tapered sled rail 114. The rails 116 and 118 may have a thickness of 6 mm, however, the thickness of the rails is not critical. The rails are designed to support the media bottom edge and provide centralized drag force to the material, thus avoiding outboard forces which may impart moments on the material which, if imbalanced, could induce skew.

The side guides 104 and 106 may be moved in and out of engagement with the sides of media items loaded into the shingle tray receptacle area 119 for a plurality of media items. The side guides 104 and 106 may be operated by any conventional mechanism or in the manner shown in U.S. patent application Ser. No. 11/123,617 filed on May 6, 2005 by James A. Solomon, Donald Surprise and Christopher D. Clarke entitled DETACHABLE FEED TRAY WITH SELF-ADJUSTING SIDE GUIDES and assigned to Pitney Bowes Inc.

The side guides 104 and 106 each engage the side edges of the media items along the entire length of each side guides. The area of the side guides 120 and 122 toward the exit area 102 are of a greater height than other the portions of the side guides. 104 and 106. This is to provide greater lateral guidance of the media item edges adjacent the exit area 108. The lower portions of the side guides 104 and 106 facilitate loading of media items into the tray. Side guide 106 is the mirror image of side guide 104, with section 122 as the mirror image of section 120.

If desired for any particular application, the side guides 104 and 106 each may be dimensioned, in an alternate arrangement not shown, to have a section toward the exit area 108 of the tray which does not engage the side edges of media items. In such alternative arrangement, the sections of the side guide 120 and 122 would be modified and configured to be out of engagement with media item side edges adjacent the exit area 108.

The side guides 104 and 106 as shown in the various figures include a section 124 shown on side guide 104 and a section 125 on side guide 106 that drop away from and are below the surface of rails 116 and 118 and surface 112 of the tray. This forms two cavity areas shown generally at 126 and 128, toward the front area 108 of the tray 102. In this area of the tray 102, media items moving toward the exit area 108 of the shingle tray are supported on the bottom edge solely on the support rails 116 and 118. Accordingly, in this area, media items such as envelopes, which have four edges are supported in the tray on their bottom edge solely by the support rails 116 and 118. The area of the tray where the bottom edge the media items is supported by and engaged by the two support rails 116 and 118 is denoted by the line 130 with two arrow heads. The side edges the media items are guided by the tray 102 by side guides 104 and 106. Additional support for the media items are from adjacent media items with the last media item to exit the tray 102 having additional support from sled 150.

Line 130 denotes the length of the support rails 116 and 118 between the front of the support rails (arrow head 130*a*) and the surface 125 of side guide 104 (arrow head 130*b*). Arrow heads 130*a* and 130*b* touch the dashed lines, signifying, respectively, the front of the rails 116 and 118 and surface 125. The corresponding surface for guide 106 is surface 127. The media items thus exit the tray 102 supported by rails 116 and 118 as they pass through the cavity areas 126 and 128 into a feeder or other mechanism. The length of the support rails 116 and 118 denoted by line 130 is 60 millimeters. However, the length is a matter of design choice and involves tradeoffs between the specified capacity of the feeder, the maximum acceptable height of the tray above the working surface, and the overall specification of system. The length of the support rails 130 is also involves a compromise between the desire for structural integrity, and the need to create cavity areas 126 and 128 of sufficient size as to accommodate shingle material having imperfections such as curl, corner deformations, and irregular cross-sections that may result in uneven bending.

The tray 102 includes an out of media sensor 132 and two rubber pads 134 and 136 at the edge of the exit area 108 of the tray 102. The rubber pads 134 and 136 help with the singulation of media as the media is moved into the feeder. A magnet 138 is provided to cooperate with a mechanism in the feeder so that the feeder can sense the type of feed tray inserted into the feeder, here shingle-type feed tray 102. The shingle feed tray 102 includes two up-stop tabs 140 and 142, which cooperate with a feeder nudger roller mechanisms to properly position the feedhead assembly 160, and thus the nudger rollers 166 and 170, with respect to the media items in the feed tray. A second magnet 144 cooperates with the out of media items sensor 132 to provide information to the feeder regarding the status of the feed tray. Arms 146 and 148 are operable to engage with the feeder mechanism to position and lock the shingle tray 102 into proper position with respect to the feeder.

The shingle tray 102 includes a spring-driven sled 150 which is mounted to the tapered sled rail 114. The sled 150 includes a handle 152 that is collapsible to pivot around the pivot 154. The handle 152 can be operated to rotate down toward the bottom surface 112 of the tray 102. The positioning of the handle 152 adjacent to the tray surface 112 facilitates loading of media items into the tray receptacle area 119. Different volumes of shingled media items may be loaded into the tray receptacle area 119 and the sled 150 moved to engage the last media item loaded into receptacle area 119.

A feeder 183 includes a feed head assembly 160 having a frame 162 which is adapted to rotate around a pivot 164. The frame 162 and thus feed head assembly 160 rotate around the pivot 164 into the appropriate position when a shingle or a stack feed tray is engaged with the feeder mechanism. The pivot 164 is connected to a frame 206 (shown most clearly in FIGS. 7 and 8) which provides the ground or base for the pivot 164 around which the feed head assembly 160 rotates. The feed head assembly 160 includes an upper nudger roller 165 having two nudger roller elements 166 and 168 and a lower nudger roller 170 having a series of ribbed surfaces. The two nudger roller elements 166 and 168 are positioned equidistant from the center line of the path of movement of media items from the shingle feed tray 102. Various types of nudger roller arrangements may be employed. For example, the upper nudger roller may be a single element nudger roller and the lower nudger roller can have three nudger roller elements. Selection of the height and width of each nudger assembly is done with the goals of minimizing skew, and controlling the attitude of the approaching shingled stack. The assembly 160 also includes a separator roller 172, which cooperates with a feed roller 174. A take-away roller 176 is also provided. The drive to the various rollers is provided by a belt drive system 178.

The feed head assembly 160 includes two recessed areas 180 and 182 that form two cavities. These recessed areas or cavities 180 and 182 are joined to the shingled media feed tray cavities 126 and 128 when the feed tray 102 is connected to the feed head assembly 160. This results in two continuous cavity areas from the exit area 108 of the feed tray 102 to the front 183 of the feed head assembly 160. Shingled feed tray cavity 128 joins with feed head assembly cavity 180 and shingled feed tray cavity 126 joins with feed head assembly cavity 182. When a shingle media tray is engaged with the feed head assembly 160, the media items are supported on rails 116 and 118, as shown in FIG. 1, until the media is moved into operative engagement with the separator roller 172 and the feed roller 174. In this manner, the media items being transitioned from the shingle tray 102 into the feed head assembly 160 are not caused to skew by any forces on the edges of the media items due to either friction with the portions of the shingle tray or friction with portions of the feed mechanism. In the region of the nudger assembly, all material has been eliminated on either side of the path of travel of the media items. As the media item is nudged from the stack to the separator, the natural bending that must occur to move the item from shingle orientation to the feed orientation takes place in the absence of outboard unbalancing forces. The feed head guide surfaces 180 and 182 emerge from beneath to provide outboard guidance after the media item has undergone the critical bending necessary to singulate it from the shingled media item stack. The central ribs down the shingle tray provide a centered drag on the media item in an area that is relatively unaffected by distortions in the media.

Figure 4:
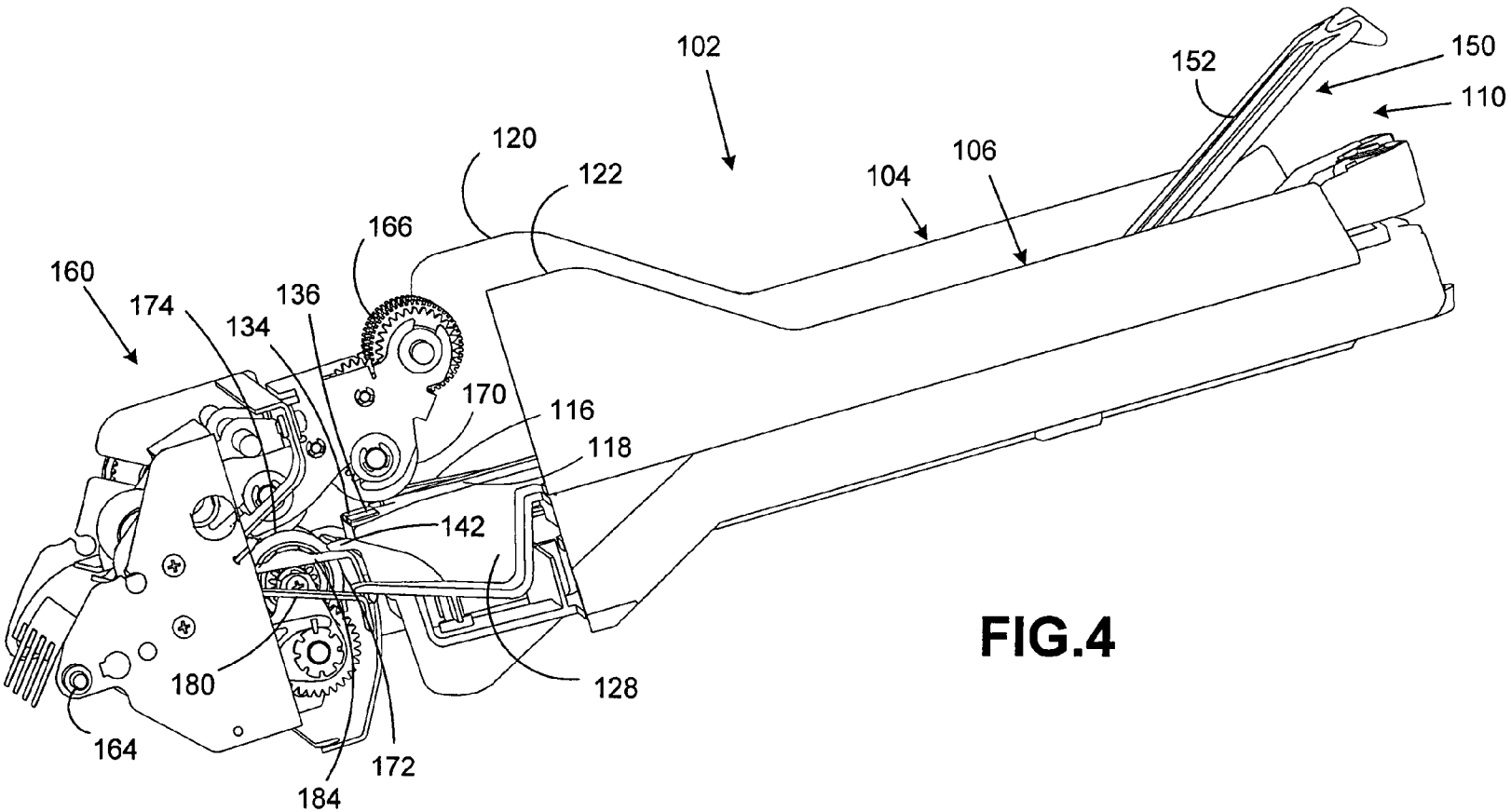
FIG. 4 is a cut away perspective side view of the shingle feed tray shown in FIG. 1 connected to the feeder shown in FIGS. 2 and 3 illustrating how the shingle feed tray engages and operates in conjunction with the feeder; and, FIG. 5 and FIG. 6 are side views of the mechanism shown in FIG. 4, with different volumes of shingled media in the shingle feed tray.

The front of the feeder 183 includes two up-stop feeder contact surfaces 184 and 186. These feeder contact surfaces cooperate with and are engaged with the two up-stop tabs 140 and 142 of the shingle feed tray 102. As is shown in FIG. 4, the tray 102 up-stop tab 142 engages the sheet metal portion 184 to lock and limit the upward or counterclockwise rotation of the feed head assembly 160 around the pivot 164 to a minimal rotation for feeding shingled media items. This minimal rotation is not related to the volume of shingled media items in shingle feed tray 102. The stops cooperate to position the nudger rollers 165 and 170 to be properly oriented so that both nudger rollers engage shingled media items exiting the feed tray 102 as they are moved on the support rail 118 and the support rail 116 (not shown in FIG. 4) into operative engagement with the separator roller 172 and the feed roller 174.

Figure 5:
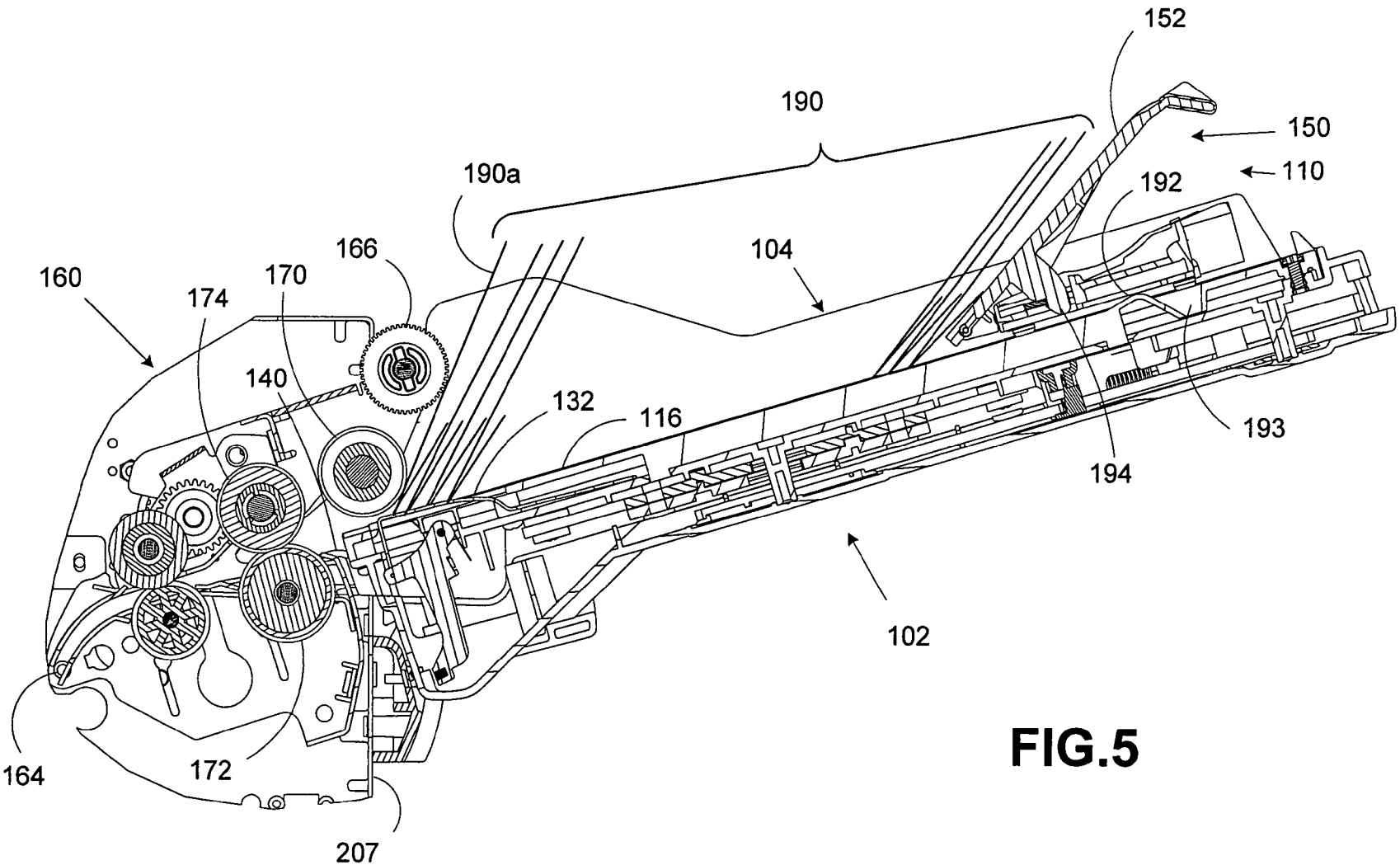
Figure 6:
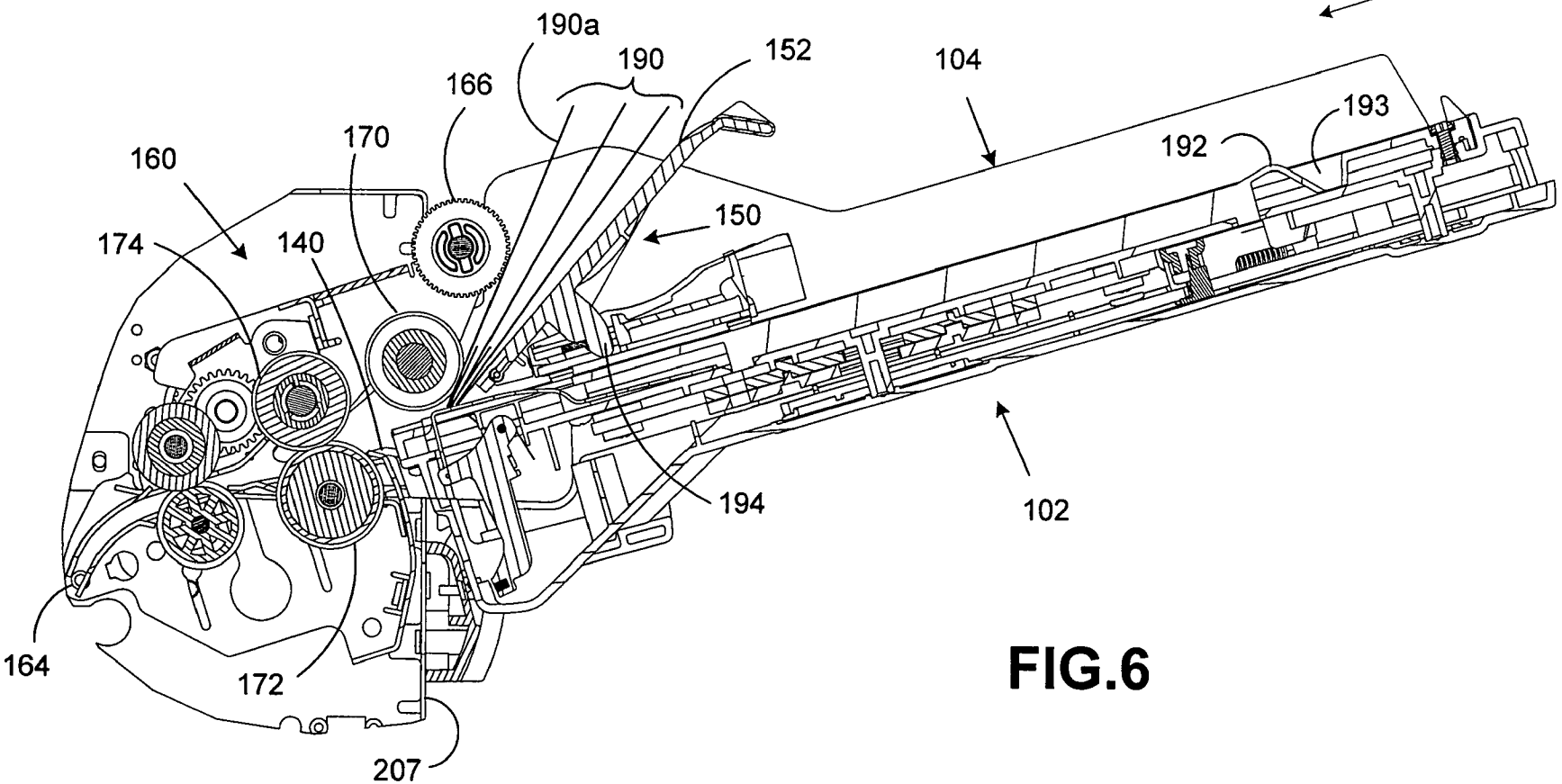

A shingled stack of media items shown as envelopes 190, as shown in FIGS. 5 and 6, are loaded into the shingle feed tray 102. The surface of the handle 152 engages the rearmost envelope in the shingled stack. The two nudger rollers 166 and 170 are shown engaging the envelope in the stack 190 closest to the exit point of the tray. The envelope 190*a* will be moved under the pressure of the spring loaded sled 150 and the operation of the nudger rollers 166 and 170 along the support rail 116 and support rail 118 (not shown in FIG. 5) into operative engagement with the separator roller 172 and the feed roller 174.

A cam surface 192 in the lower surface of the tray 102 cooperates with a cam follower locking tab projection 194 attached to the handle of 152 of the sled 150. The function of the cam 192 is to ensure that the handle is camed to the position shown where it is positioned to support shingled media items as the sled is moved toward the front of the tray 102. Accordingly, after the media items are loaded into the tray 102 with the handle in the collapsed position, as the sled is moved toward the media exit end of the tray, the handle 152 is caused to rotate in a counterclockwise direction to be properly positioned to support the shingle media in the correct orientation for cooperation with the feed head assembly 160 and, more specifically, the feeder nudger rollers 165 and 170.

The stack of media items 190 is smaller, as shown in FIG. 6, than the stack of media items shown in FIG. 5. Accordingly, in FIG. 6, the sled 150 is located closer to the exit area of the shingle feed tray as compared to FIG. 5. The sled 150 and the energy stored in the sled spring (not shown in FIG. 6) has been employed to help move the media items into the feed head assembly 160.

The shingle feed tray 102, when engaged with the feeder 183, as is shown in FIGS. 4, 5 and 6, provides approximately a 4 mm gap for shingled media items to be fed out of the shingle feed tray 102. The particular gap size is a matter of design choice. The gap is provided for a shingled media item to move under the nudger roller 170 and into the nip of the separator roller 174 and feed roller 172. The movement of the feed head assembly along this small gap is limited in its clockwise direction by the engagement of the two up-stop tabs 140 and 142 and the two contact surfaces 172 and 186. The clockwise rotation is limited by the interference of the nudger roller 170 and the surface of the shingle feed tray tapered sled rail 114. When the media items have been depleted or are otherwise not in the shingle feed tray 102, the lower nudger roller 170 rests on the portion of the tapered rail adjacent to the out of paper sensor 132. The two tapered rails slope downward below the tapered sled rail. The tapering of the rails brings the lead edge of the advancing material into direct contact with the tapered sled rail and the two retard pads 134 and 136. The contact initiated with the retard pads 134 and 136 acts as a secondary separation mechanism that reduces the propensity of the feed system to present a multitude of shingled elements to the separation system.

The unbalancing forces on the shingled media items are minimized in the feed head assembly 160, by removing contact with the sides of the media items outboard of the center of the media items. This removing of contact may extend between the exit area 108 of the shingle feed tray and the front 183 of the feeder. In the arrangement shown in the various figures, contact has been removed from the sides of the media items outboard of the center of the media items for a distance of, for example, three inches running from a point approximately tangent to the front of roller 166 and perpendicular to the tray surface 116 to the nip created by the separator roll 172 and feed roll 174. Media items advance down the shingle feed tray 102 on the two central rails 116 and 118, arriving at the nudger rollers 165 and 170. The side guides 104 and 106 provide side to side guidance and some vertical support for the media items over most of the length of stack advancement of the media items. But, in the region of the nudgers 165 and 170, all material has been eliminated on either side of the media item path of movement. The feeder separator roller 172 and a feed roller 174 are positioned with respect to the cavities or recess 126, 128 of the feed tray (when connected to the feeder) and cavities or recess 180 and 182 of the feeder 183. This position is such that when the media items are moved from a shingle orientation, at the upstream side of the separator roller 172 and the feed roller 174, to a media feed orientation, at the down stream side of said separator roller 172 and the feed roller 174, the change in media item orientation occurs with the media item side edges out of contact with lower guide surfaces of the shingle feed tray 102 and guide surfaces of the feeder 183. Media item bending associated with changing the media item orientation occurs in the absence of unbalancing forces on the media item edges. Guidance of the media item at the down stream side of the separator roller 172 and the feed roller 174 is provided by guide surface 184 and 186. Guide surface 184 and 186 provides media item guidance after the media item has moved from said shingle orientation to said feed orientation.

The term media item is intended herein to be a broad term and to include mail pieces such as various types of mail pieces such as letter mail and postcards. Other examples of media items include sheets of paper, checks, envelopes, slips, booklets, packages of greeting cards, and any other items that can be fed from a shingle type feed tray. Accordingly, while the detailed description is directed to the processing envelopes and flat documents, any other suitable media items can be substituted for such media items in the description. Additionally, the term cavity or recess is intended to be a broad term. The cavities or recesses can be of any size or shape that results in the surfaces of the feeder and/or feed tray being out of contact with the portion of the media item edges to provide the functionality. The cavity or recess can open, partially open or enclosed. The cavity areas can be one contiguous cavity or separate cavity areas so long as the appropriate clarity areas are provided for the media items to achieve the functionality. Different types and arrangements of nudger rollers may be employed as well as other types of pivoting and latching mechanisms for the rollers alone or for the feed head assembly and trays. Various arrangements of feed and separator rollers, cavities or recessed structures and drives may be employed for feeding and separating the media from the stack of media items in the trays.

While the present invention has been described in connection with what is presently considered to be the most practical and preferred embodiments, it is to be understood that the invention is not limited to the disclosed embodiment, but, on the contrary, is intended to cover various modifications and equivalent arrangements included within the spirit and scope of the appended claims.

What is claimed is:

1. A shingled media item feeding arrangement for feeding media items having a bottom edge, comprising:

a tray for supporting a stack of shingled media items, said tray having an exit area and a support surface that supports said bottom edge of said media items;

a feeder for separating and feeding media items from said shingled stack of media items; and, said tray connected to said feeder and having a first and a second cavity formed at the exit area of said feed tray and the front of said feeder, said first and second cavities located outboard from said support surface such that media items moved from said tray into said feeder are supported on a first portion of said media item bottom edge but are not supported on first and second portions of said bottom edge along the first and second cavities.

2. A shingled media item feeding arrangement as defined in claim 1 wherein said support surface includes first and second sections spaced apart from each other such that said media items moved from said tray into said feeder are supported on said media item bottom edge by said first and second sections.

3. A shingled media item feeding arrangement as defined in claim 2 wherein said media item bottom edge has a center point and said first and second sections are on opposite sides of said media item bottom edge center point.

4. A shingled media item feeding arrangement as defined in claim 3 wherein said first and second sections are equidistant from said media item bottom edge center point.

5. A shingled media item feeding arrangement as defined in claim 1 wherein said feeder includes a separator roller and a feed roller and said first and said second cavity are formed such that said media items are supported on media item bottom edge by said support surface until said media item is moved into operative engagement with said separator roller and said feed roller.

6. A shingled media item feeding arrangement as defined in claim 1 wherein said feeder includes a separator roller and a feed roller positioned with respect to said first and said second cavity such that said media items are moved from a shingle orientation at the upstream side of said separator roller and said feed roller to a media item feed orientation at the down stream side of said separator roller and said feed roller such that media item bending occurs in the absence of unbalancing forces on said media item edges.

7. A shingled media item feeding arrangement as defined in claim 6 wherein said feeder includes and a guide surface mounted to the down stream side of said separator roller and said feed roller for down stream guidance of said media item after said media item has moved from said media item shingle orientation to said media item feed orientation.

8. A shingled media item feeding arrangement as defined in claim 6 wherein said feed tray is detachably connected to said feeder.

9. A feeder for a shingled stack of media items, comprising:

a feed head having media item guide surfaces, a separator roller and a feed roller for separating and feeding media items from said shingled stack of media items and a first and a second cavity area; and, said separator roller and said feed roller positioned with respect to said first and said second cavity area such that said media items are moved from a media item shingle orientation upstream of said separator roller and said feed roller to a media item feed orientation down stream of said separator roller and said feed roller with said media item side edges out of contact with said feed head guide surfaces whereby media item bending occurs in the absence of unbalancing forces on said media item edges.

10. A feeder for a shingled stack of media items as defined in claim 9 wherein said guide surfaces includes a guide surface mounted down stream side of said separator roller and said feed roller such that said guide surface guides said media items after said media items have moved from said media item shingle orientation to said media item feed orientation.

* * * * *